US011358390B2

(12) United States Patent
Cumbie et al.

(10) Patent No.: US 11,358,390 B2
(45) Date of Patent: Jun. 14, 2022

(54) CARRIERS INCLUDING FLUID EJECTION DIES

(71) Applicant: Hewlett-Packard Development Company, L.P., Spring, TX (US)

(72) Inventors: Michael Cumbie, Corvallis, OR (US); Chien-Hua Chen, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/251,856

(22) PCT Filed: Sep. 27, 2018

(86) PCT No.: PCT/US2018/053037
§ 371 (c)(1),
(2) Date: Dec. 14, 2020

(87) PCT Pub. No.: WO2020/068081
PCT Pub. Date: Apr. 2, 2020

(65) Prior Publication Data

US 2021/0252859 A1 Aug. 19, 2021

(51) Int. Cl.
*B41J 2/14* (2006.01)
*B41J 2/175* (2006.01)

(52) U.S. Cl.
CPC .... *B41J 2/1433* (2013.01); *B41J 2002/14491* (2013.01)

(58) Field of Classification Search
None
See application file for complete search history.

(56) References Cited

U.S. PATENT DOCUMENTS 5,442,386 A * 8/1995 Childers ..... B41J 2/1623 347/50
5,874,974 A * 2/1999 Courian ..... B41J 2/1404 347/100

(Continued)

FOREIGN PATENT DOCUMENTS

CN 1684831 A 10/2005
CN 108136777 A 6/2018

(Continued)

*Primary Examiner* — Jason S Uhlenhake
(74) *Attorney, Agent, or Firm* — HP Inc. Patent Department

(57) ABSTRACT

Examples include a fluid ejection device comprising a carrier, at least one fluid ejection die, and conductive traces at least partially embedded in the carrier. The carrier has a first portion and a second portion, where an angle of orientation between the first portion and the second portion is nonparallel. The first portion includes an array of openings formed through a top surface of the carrier. The second portion includes at least one die opening through a bottom surface of the carrier. The fluid ejection die is coupled to the second portion of the carrier. Fluid passages formed in a back surface of the fluid ejection die are exposed through the at least one die opening formed through the bottom surface of the carrier. The conductive traces have an array of contact points at first ends of the conductive traces. The array of contact points align with the array of openings of the first portion of the carrier such that the array of contact points are exposed through the array of openings. The conductive traces connect the fluid ejection die and the array of contact points.

15 Claims, 15 Drawing Sheets

(56) References Cited

U.S. PATENT DOCUMENTS

| | | | | |
|---|---|---|---|---|
| 5,946,012 | A | 8/1999 | Courian et al. | |
| 6,322,200 | B1 | 11/2001 | Feinn | |
| 6,394,580 | B1 | 5/2002 | Scheffelin et al. | |
| 6,722,756 | B2 * | 4/2004 | Choy | B41J 2/16505 347/29 |
| 8,226,212 | B2 | 7/2012 | Swier et al. | |
| 8,308,273 | B2 | 11/2012 | Silverbrook et al. | |
| 8,496,317 | B2 | 7/2013 | Ciminelli et al. | |
| 8,517,514 | B2 | 8/2013 | Dietl | |
| 8,690,296 | B2 | 4/2014 | Ciminelli et al. | |
| 8,702,200 | B2 | 4/2014 | Choy | |
| 2004/0061741 | A1 | 4/2004 | Aschoff et al. | |
| 2005/0231551 | A1 | 10/2005 | Gibson et al. | |
| 2007/0093001 | A1 | 4/2007 | Garcia et al. | |
| 2015/0210077 | A1 | 7/2015 | Tomizawa et al. | |
| 2016/0001558 | A1 | 1/2016 | Chen et al. | |
| 2017/0190174 | A1 | 7/2017 | Dodd et al. | |

FOREIGN PATENT DOCUMENTS

| | | | |
|---|---|---|---|
| CN | 108367568 | A | 8/2018 |
| EP | 1946929 | | 7/2008 |
| WO | WO-2017/078661 | | 5/2017 |
| WO | 2017/146699 | A1 | 8/2017 |

* cited by examiner

CARRIERS INCLUDING FLUID EJECTION DIES

BACKGROUND

Microfluidic devices may correspond to various microelectromechanical systems which convey, dispense, and/or process small volumes (e.g., microliters) of fluids. Some example microfluidic devices include fluid ejection devices and fluid sensors. As a further example of a fluid ejection device, printheads are devices configured to controllably dispense fluid drops.

DRAWINGS

Figure 1:
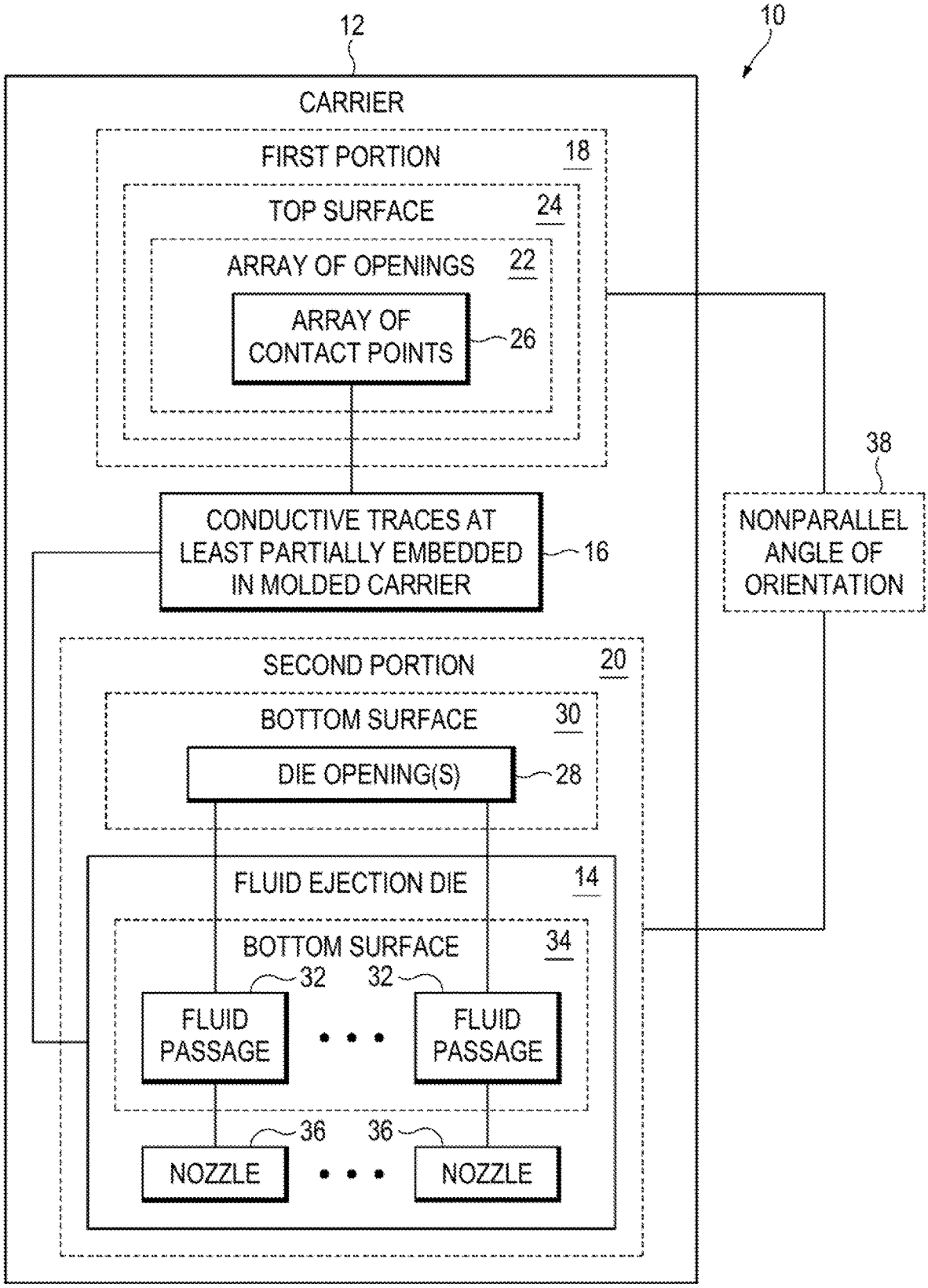
FIG. 1 is a block diagram that illustrates some components of an example fluid ejection device.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DESCRIPTION

Examples of fluid ejection devices may comprise a carrier, at least one ejection die, and plurality of conductive traces at least partially embedded in the carrier. In examples provided herein, the carrier may be described as a rigid carrier. The conductive traces may have an array of contact points at a first end, where the contact points generally correspond to pad connections where external connectors may interface. The carrier may comprise a first portion and a second portion, where an angle of orientation between the first portion and the second portion is nonparallel. In the first portion, the carrier may include an array of openings formed through a top surface of the carrier. The array of openings and the array of contact points of the conductive traces may be aligned such that external connectors may engage with the array of contact points through the array of openings. In the second portion, the carrier may have a die opening formed through the carrier such that such that fluid passages formed through a back surface of the at least one fluid ejection die may be exposed. In some examples, the die opening may correspond to at least one fluid channel of the carrier, where the at least one fluid channel may align with and fluidically couple to the fluid passages formed through a back surface of the at least one fluid ejection die.

In some examples, the carrier may be a molded carrier, and at least one ejection may be molded into the molded carrier. As used herein, molded in to the molded carrier may refer to the ejection die being at least partially embedded in the molded carrier. In other examples, the at least one ejection die may be coupled to a chiclet, and the chiclet may be coupled to the carrier in a recess of the carrier. In some examples, a carrier may be formed by a molding process. In other examples, a carrier may be formed by an encapsulation process. In other examples, a carrier may be formed by other machining processes such as cutting, grinding, bonding, etc.

In some examples, a fluid ejection die may comprise a plurality of nozzles, where the nozzles may be used to selectively dispense fluid drops. In further examples comprising nozzles, the fluid ejection die may correspond to a printhead that may selectively dispense printing material by ejecting fluid drops via the nozzles. A top surface of a fluid ejection die may include nozzle orifices formed therein, and a nozzle layer of the fluid ejection die may include the nozzles formed therethrough and terminating at the nozzle orifices on the top surface. The nozzles of a fluid ejection die may be fluidically coupled to a fluid chamber, where the fluid chambers may be formed in a chamber layer of the fluid ejection die that is adjacent to the nozzle layer. A fluid actuator may be disposed in each fluid chamber, and actuation of a respective fluid actuator may cause displacement of fluid in a respective fluid chamber in which the fluid actuator is positioned. Displacement of the fluid in the respective fluid chamber in turn may cause ejection of a fluid drop through a respective nozzle fluidically coupled to the respective fluid chamber. To supply fluid to the fluid chambers, the fluid ejection die may comprise fluid passages formed through a back surface of the die and fluidically coupled to the fluid chambers.

Some examples of types of fluid actuators implemented in fluid ejection devices include thermal ejectors, piezoelectric ejectors, and/or other such ejectors that may cause fluid drops to eject/be dispensed from a nozzle orifice. In some examples the fluid ejection dies may be formed with silicon or a silicon-based material. Various features, such as nozzles, fluid chambers, and fluid passages may be formed from various materials used in silicon device based fabrication, such as silicon dioxide, silicon nitride, metals, epoxy, polyimide, other carbon-based materials, etc. Where such fluidic features may be formed by various microfabrication processes, such as etching, deposition, bonding, cutting, and/or other such microfabrication processes.

In some examples, fluid ejection dies may be referred to as slivers. Generally, a sliver may correspond to a fluid ejection die having: a thickness of approximately 650 μm or less; exterior dimensions of approximately 30 mm or less; and/or a length to width ratio of approximately 3 to 1 or larger. In some examples, a length to width ratio of a sliver may be approximately 10 to 1 or larger. In some examples, a length to width ratio of a sliver may be approximately 50 to 1 or larger. In some examples, fluid ejection dies may be a non-rectangular shape. In these examples a first portion of the fluid ejection die may have dimensions/features approximating the examples described above, and a second portion of the fluid ejection die may be greater in width and less in length than the first portion. In some examples, a width of the second portion may be approximately 2 times the size of the width of the first portion. In these examples, a fluid ejection die may have an elongate first portion along which nozzles may be arranged, and the fluid ejection die may have a second portion upon which electrical connection points for the fluid ejection die may be arranged.

In some examples, a carrier may be formed of a single material, i.e., the carrier may be uniform. Furthermore, in some examples, a carrier may be a single piece, i.e., the carrier may be monolithic. In some examples, a molded carrier and/or a molded chiclet may comprise an epoxy mold compound, such as CEL400ZHF40WG from Hitachi Chemical, Inc., and/or other such materials. In another example, the molded carrier and/or molded chiclet may comprise thermal plastic materials such as PET, PPS, LCP, PSU, PEEK, and/or other such materials. Accordingly, in some examples, the molded carrier and/or molded chiclet may be substantially uniform. In some examples, the molded carrier and/or molded chiclet may be formed of a single piece, such that the molded carrier and/or molded chiclet may comprise a mold material without joints or seams. In some examples, the molded carrier and/or molded chiclet may be monolithic. As used herein, a molded carrier and/or molded chiclet may not refer to a process in which the carrier and/or chiclet may be formed; rather, a molded carrier and/or molded chiclet may refer to the material from which the carrier and/or chiclet may be formed.

Furthermore, some example fluid ejection devices may comprise a support frame substantially embedded in the carrier. The support frame may include support members formed of a support material connected and extending generally along a width of the carrier. Example support materials may include, for example, various metals such as gold, nickel, copper, alloy 42, stainless steel, aluminum, tin, various alloys, and/or any combination thereof, including materials plated in the aforementioned examples.

Example fluid ejection devices, as described herein, may be implemented in printing devices, such as two-dimensional printers and/or three-dimensional printers (3D). As will be appreciated, some example fluid ejection devices may be printheads. In some examples, a fluid ejection device may be implemented into a printing device and may be utilized to print content onto a media, such as paper, a layer of powder-based build material, reactive devices (such as lab-on-a-chip devices), etc. Example fluid ejection devices include ink-based ejection devices, digital titration devices, 3D printing devices, pharmaceutical dispensation devices, lab-on-chip devices, fluidic diagnostic circuits, and/or other such devices in which amounts of fluids may be dispensed/ejected.

In some examples, a printing device in which a fluid ejection device may be implemented may print content by deposition of consumable fluids in a layer-wise additive manufacturing process. Consumable fluids and/or consumable materials may include all materials and/or compounds used, including, for example, ink, toner, fluids or powders, or other raw material for printing. Furthermore, printing material, as described herein may comprise consumable fluids as well as other consumable materials. Printing material may comprise ink, toner, fluids, powders, colorants, varnishes, finishes, gloss enhancers, binders, fusing agents, inhibiting agents, and/or other such materials that may be utilized in a printing process.

Turning now to the figures, and particularly to FIG. 1, this figure provides a block diagram that illustrates some components of an example fluid ejection device 10. In this example, the fluid ejection device 10 comprises a carrier 12 and a fluid ejection die 14 coupled to the carrier 12. The device 10 further includes conductive traces 16 that are at least partially embedded in the carrier 12. As shown, the carrier 12 includes a first portion 18 and a second portion 20. The first portion 18 includes an array of openings 22 formed through a top surface 24 of the carrier 12. As shown, the conductive traces 16 have an array of contact points 26 at a first end of the conductive traces 16. The array of contact points 26 correspond with the array of openings 22 formed through the top surface 24 of the carrier 12. In this example, the conductive traces 16 are connected to the fluid ejection die 14 at a second end.

The second portion 20 of the carrier 12 has at least one opening 28 formed through a bottom surface 30 of the carrier 12. In such examples, the fluid ejection die 14 is positioned over the at least one die opening 28 such that fluid passages 32 formed through a bottom surface 34 of the fluid ejection die 14 may be exposed through the die opening 28 formed in the second portion 20 of the carrier 12. In some examples, the at least one die opening 28 may correspond to fluid channels that fluidically couple to the fluid passages 32 of the fluid ejection die 14. The fluid passages 32 may be fluidically coupled to nozzles 36 of the fluid ejection die 14. Furthermore, the first portion 18 and the second portion 20 of the carrier may have a nonparallel angle of orientation 38 therebetween. As previously described, in some examples, a molded carrier may be uniform and/or monolithic such that the molded carrier forms a single uniform body without seams or joints. Taken in the context of the example of FIG. 1, the nonparallel angle of orientation 38 between the first portion 18 and the second portion 20 of a carrier 12 that is a molded carrier thereby corresponds to a monolithic molded body having an angle of orientation formed with the material of the molded carrier 12. Other examples may comprise other types of materials and formations thereof.

Figure 2:
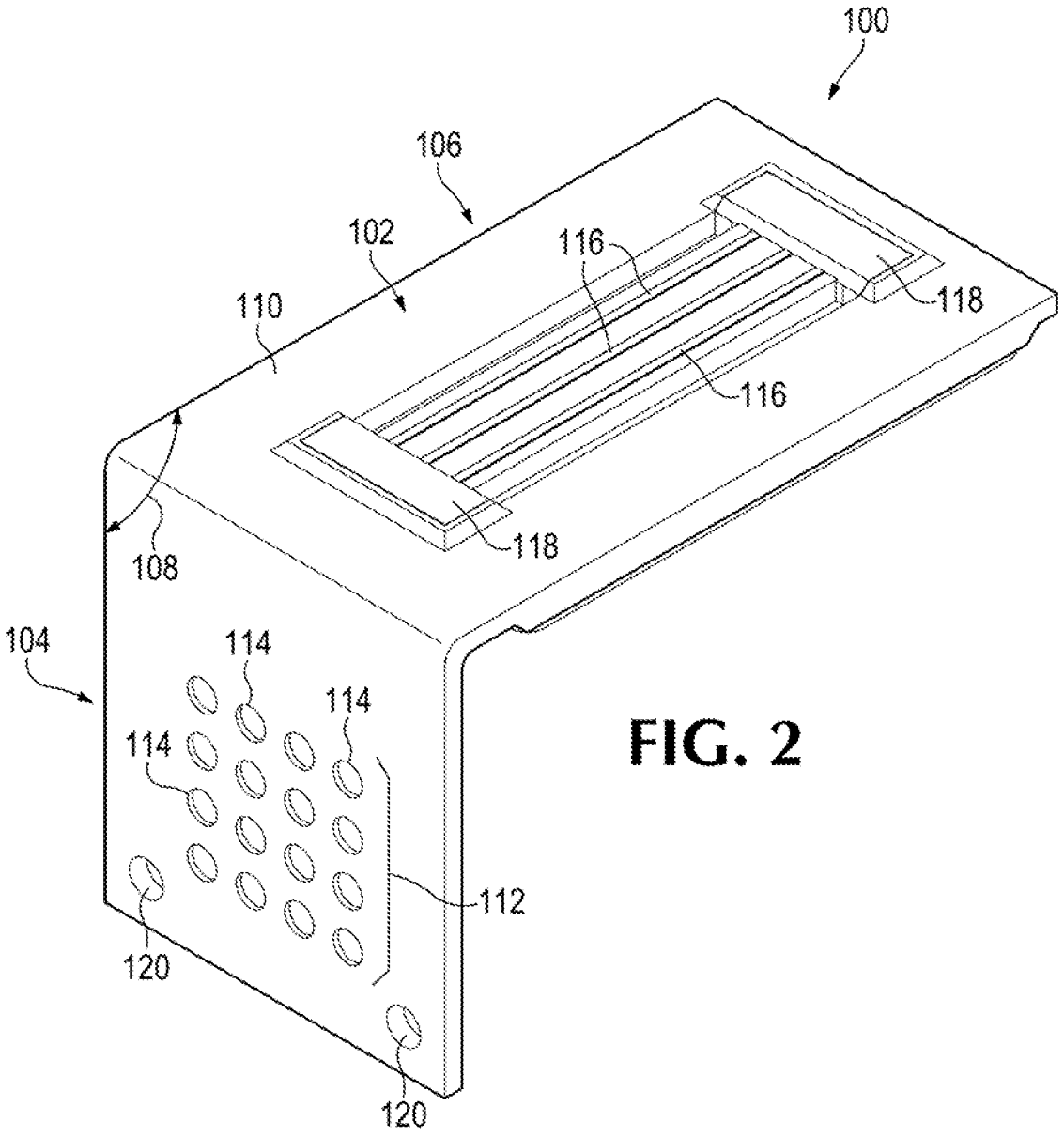
FIG. 2 is an isometric view that illustrates some components of an example fluid ejection device.
Figure 3:
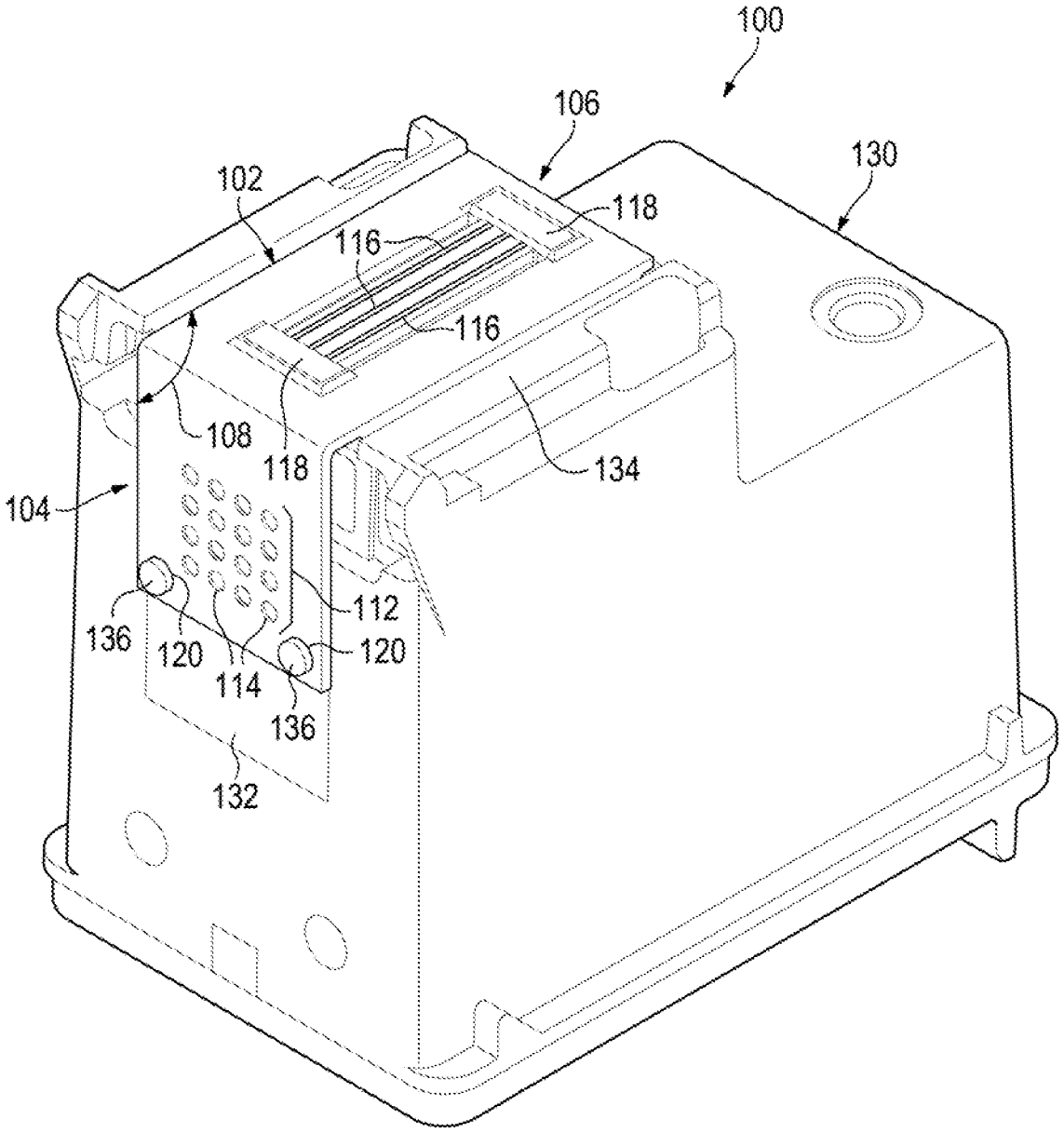
FIG. 3 is an isometric view that illustrates some components of an example fluid ejection device.

FIGS. 2-3 provide isometric views of some components of an example fluid ejection device 100. As shown, the example fluid ejection device 100 includes a rigid carrier 102 having a first portion 104 and a second portion 106. An angle of orientation 108 between the first portion 104 and the second portion 106 is nonparallel. In this example, the angle of orientation between the plane formed by a top surface 110 of the carrier 102 from the first portion 106 and the plane formed by the top surface of the carrier 102 from the second portion 104 is approximately orthogonal. For example, the angle of orientation 108 may be in a range of approximately 75° and approximately 105°. In some examples, the angle of orientation may be in a range of approximately 85° and approximately 95°.

As shown, an array of openings 112 may be formed on the top surface 110 of the carrier 102 in the first portion 104. Corresponding with and aligned to the array of openings 112, the fluid ejection device further includes an array of contact points 114 that correspond to a first end of a plurality of conductive traces (not shown) at least partially embedded in the molding of the carrier 102. The conductive traces are not illustrated in the example of FIGS. 2-3 due to the conductive traces being embedded in the carrier 102. However, the conductive traces extend from the contact points 114 positioned at the first portion 104 to connect, at a second end, to fluid ejection dies 116 coupled to the second portion of the carrier 102. In this example, the fluid ejection device 100 comprises three fluid ejection dies 116 coupled to the carrier 102. In this example, to secure the fluid ejection dies 116 and also seal any exposed electrical portions on the fluid ejection dies.

Moreover, as shown, top surfaces of the fluid ejection dies 116 may be approximately planar with the top surface 110 of the second portion 106 of the carrier 102. It may be further noted that the material of the carrier 102 (e.g., an epoxy mold material, an encapsulating material, etc.) may substantially surround the sides of the fluid ejection dies 116. Furthermore, the fluid ejection device 100 includes sealing cap members 118 to secure the fluid ejection dies 116 such that the fluid ejection dies 116 may be described as at least partially embedded in and enclosed by the material of the carrier 102. In FIG. 2, the first portion 104 of the carrier 102 includes alignment openings that pass through the carrier 102.

Referring now specifically to FIG. 3, as shown, the carrier 102 may be coupled to a fluid cartridge housing 130. In particular, the first portion 104 of the carrier 102 may couple to an electrical interface portion 132 of the fluid cartridge housing 130, and the second portion 106 of the carrier 102 may couple to a fluid coupling portion 134 of the fluid cartridge housing 130. Furthermore, as shown in FIG. 3, the fluid cartridge housing 130 may include alignment members 136. As shown, the alignment members 136 of the fluid cartridge housing 130 interface with the alignment openings 120 of the carrier 102. In some examples, the alignment members 136 may pass through the alignment openings 120, and after coupling, the alignment members may be heated to thereby secure the carrier 102 to the fluid cartridge housing 130.

Figure 4A:
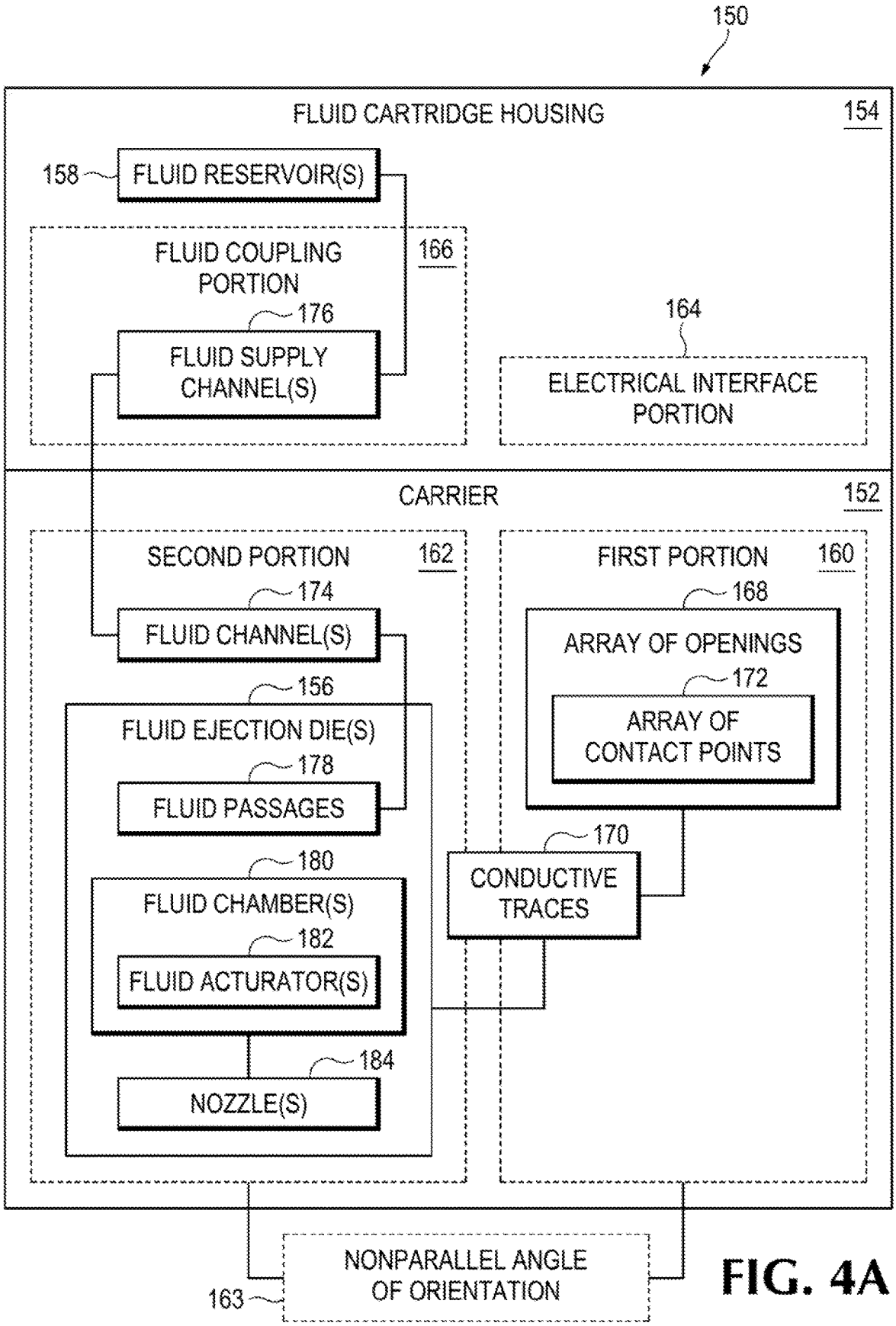
FIG. 4A is a block diagram that illustrates some components of an example fluid ejection device.
Figure 4B:
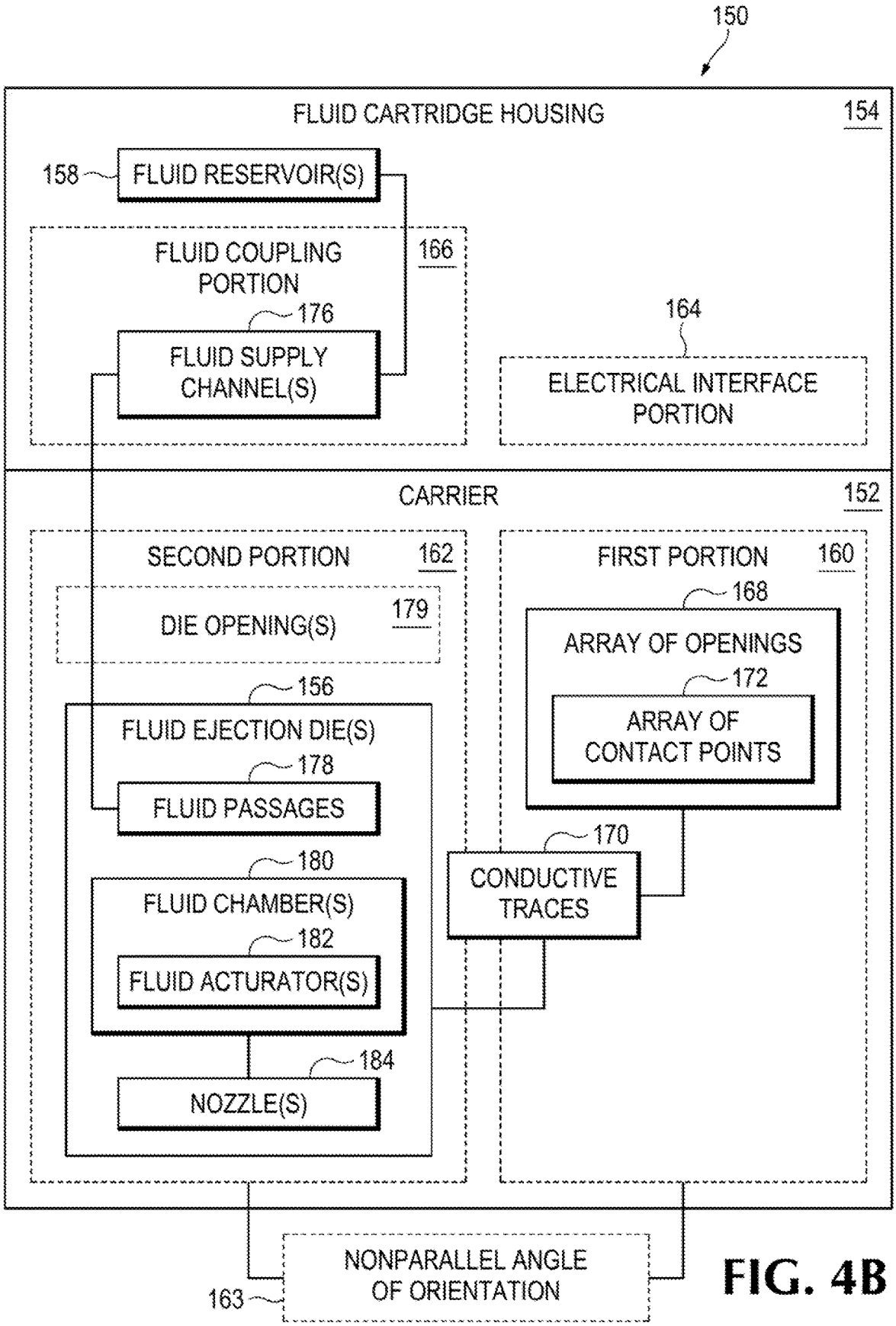
FIG. 4B is a block diagram that illustrates some components of an example fluid ejection device.

Turning now to FIGS. 4A-B, these figures provide block diagrams that illustrate some components of an example fluid ejection device 150. The fluid ejection device 150 includes a carrier 152 coupled to a fluid cartridge housing 154. At least one fluid ejection die 156 is coupled to the carrier 152. The fluid cartridge housing 154 has at least one fluid reservoir 158 contained therein. The carrier 152 includes a first portion 160 and a second portion 162, where the carrier 152 is configured with a nonparallel angle of orientation 163 between the first portion 160 and the second portion 162. The carrier 152 is coupled to the fluid cartridge housing 154 such that the first portion 160 of the carrier is coupled to an electrical interface portion 164 and the second portion 162 is coupled to a fluid coupling portion 166.

The carrier 152 includes an array of openings 168 formed through a top surface of the first portion 160 of the carrier 152. The fluid ejection device 150 further comprises a plurality of conductive traces 170, where a first end of the plurality of conductive traces 170 forms an array of contact points 172, and a second end of the plurality of conductive traces may be connected to the at least one fluid ejection die 156. As shown, the array of contact points 172 may be aligned with the array of openings 168 such that external connectors may interface with the array of contact points 172 through the array of openings 168.

In the example of FIG. 4A, the carrier 152 further includes at least one fluid channel 174 formed through a bottom surface of the carrier 152. The at least one fluid channel 174 of the carrier 152 is aligned with and fluidically coupled to at least one fluid supply channel 176 formed through the fluid cartridge housing 154. In addition, the at least one fluid channel 174 of the carrier 152 is fluidically coupled to fluid passages 178 formed through a back surface of the at least one fluid ejection die 156. In the example of FIG. 48, the carrier 152 includes at least one die opening 179 formed therethrough. In examples similar to FIG. 48, the fluid supply channels 176 of the fluid coupling portion 166 of the fluid cartridge housing 154 may fluidically couple directly to the fluid passages 178 of the at least one fluid ejection die 178. In turn, the fluid passages 178 may be fluidically coupled to fluid chambers 180. The fluid ejection die 156 may include a respective fluid actuator 182 disposed in each respective fluid chamber 180. A respective nozzle 184 may be fluidically coupled to each respective fluid chamber 180.

Accordingly, fluid may be supplied from the at least one fluid reservoir 158 of the fluid cartridge housing 154 to fluid chambers 180 of the fluid ejection die 156 via the fluid supply channel 176 of the fluid cartridge housing 158, the fluid channel 174 of the carrier 152 (in examples similar to FIG. 4A), and the fluid passages 178 of the fluid ejection die 156. Actuation of the fluid actuators 182 of the fluid ejection die 156 may facilitate selective ejection of fluid drops from the fluid chambers 180 of the fluid ejection die 156.

Figure 5:
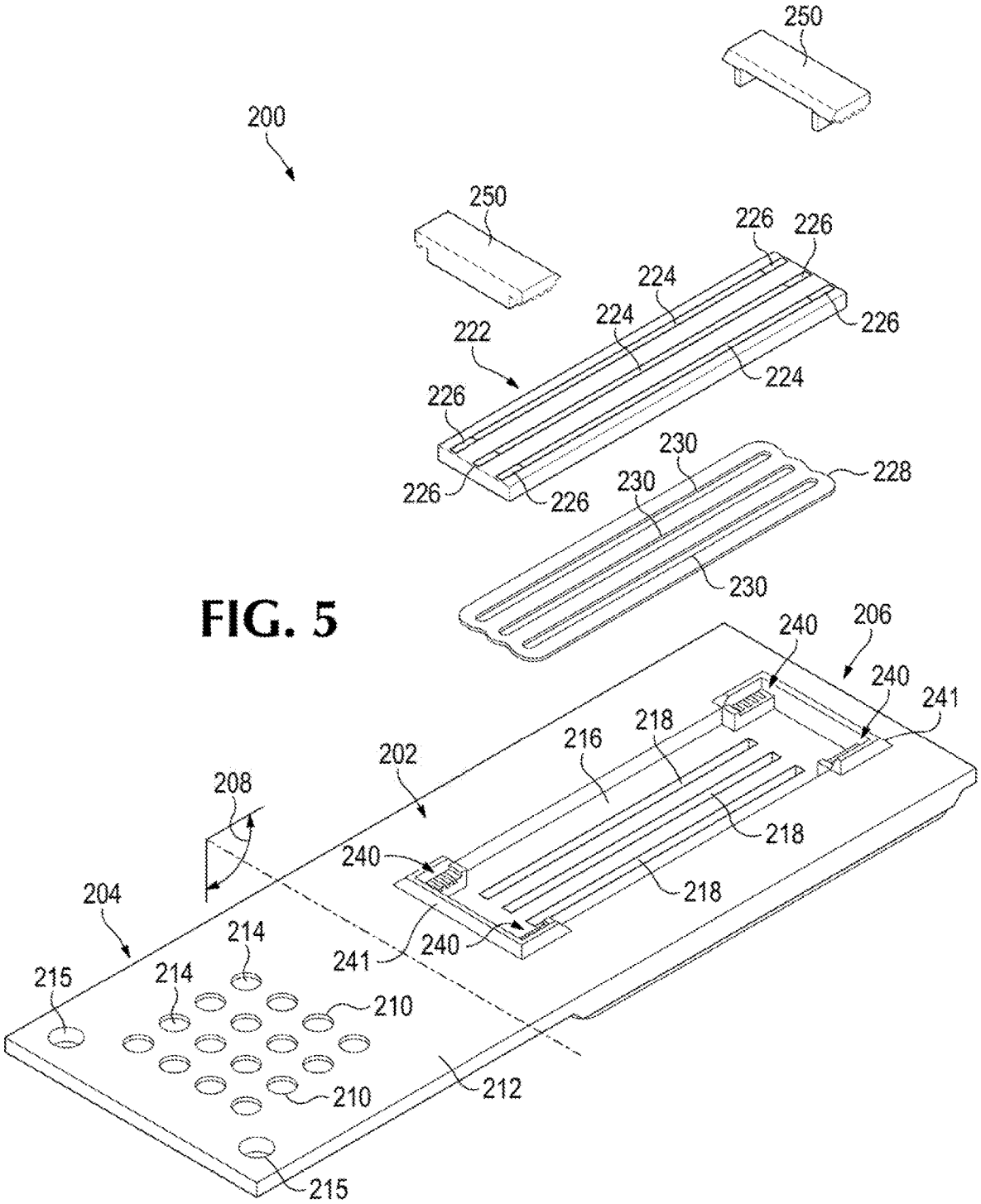
FIG. 5 is a top perspective exploded isometric view of some components of an example fluid ejection device.
Figure 6:
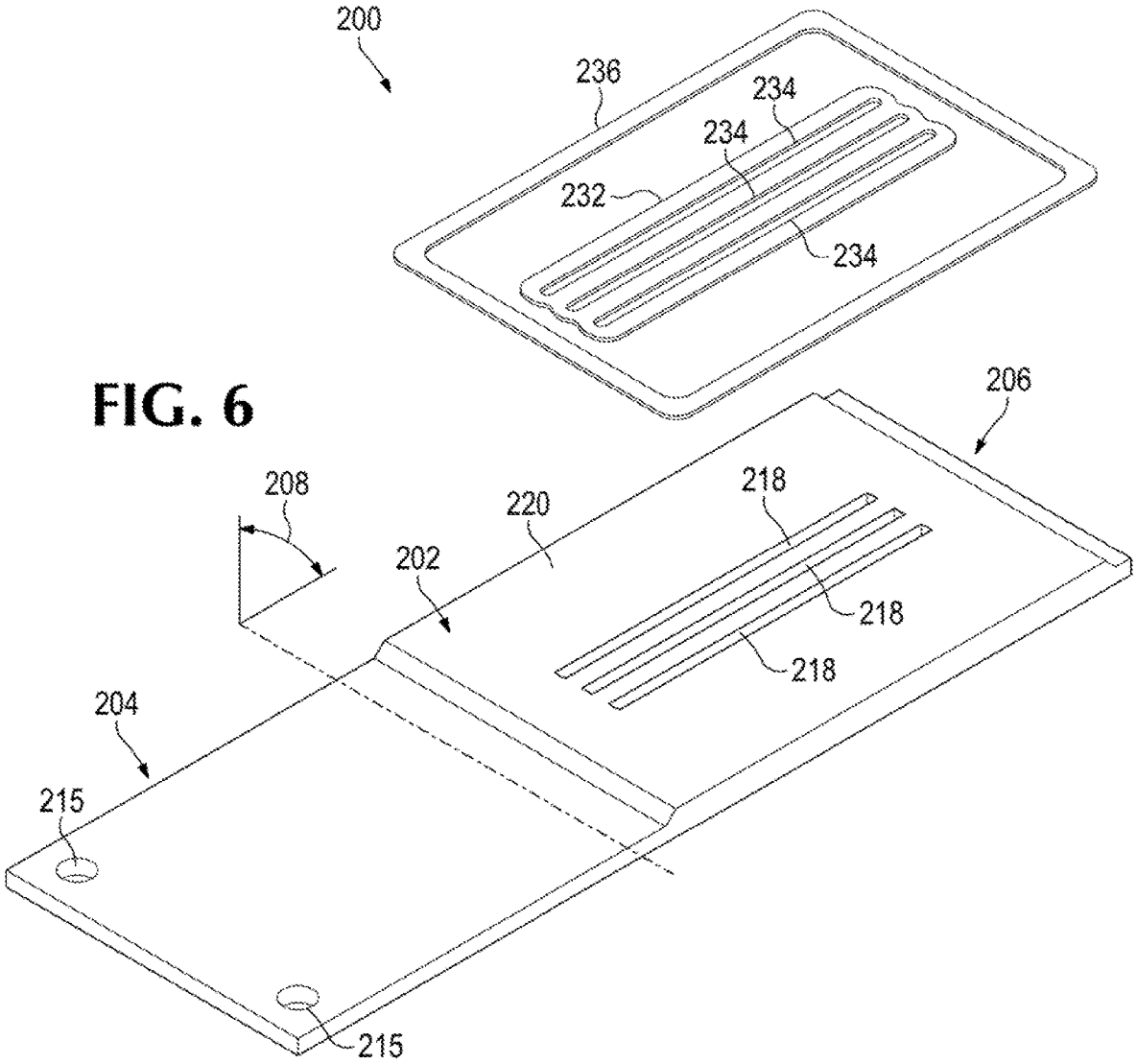
FIG. 6 is a top perspective exploded isometric view of some components of an example fluid ejection device.
Figure 7:
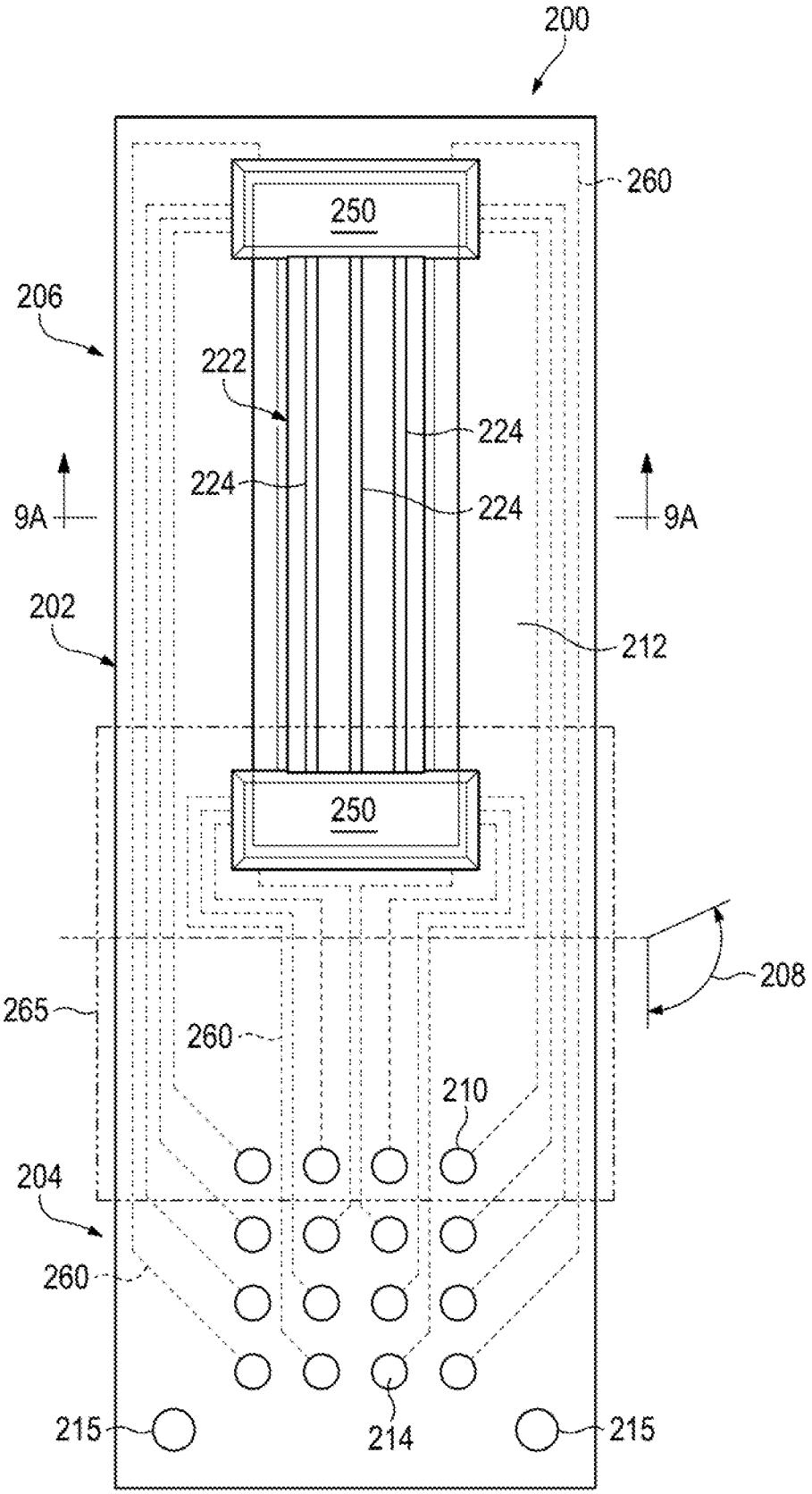
FIG. 7 is a top view of some components of an example fluid ejection device.
Figure 8:
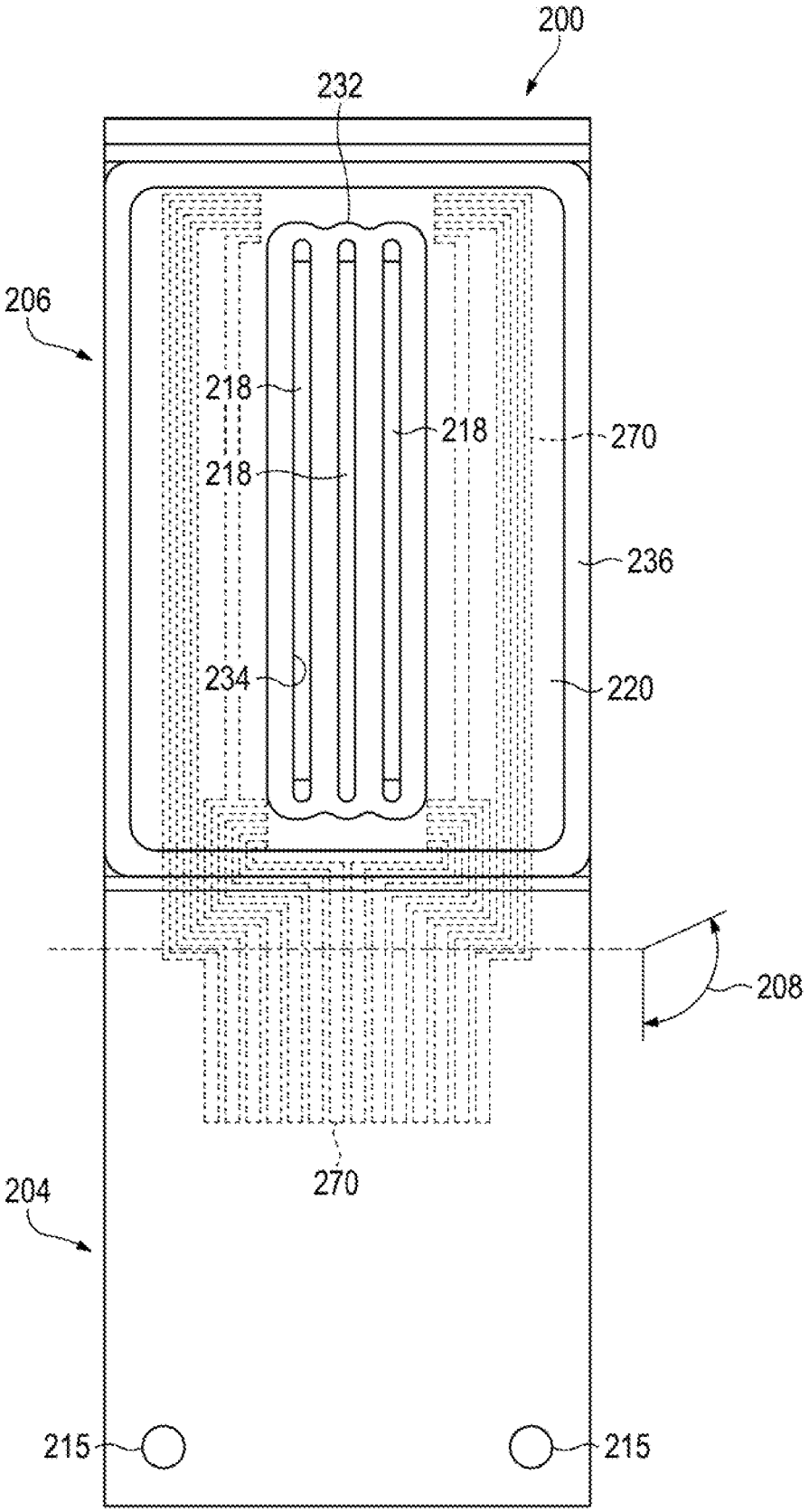
FIG. 8 is a bottom view of some components of an example fluid ejection device.
Figure 9A:
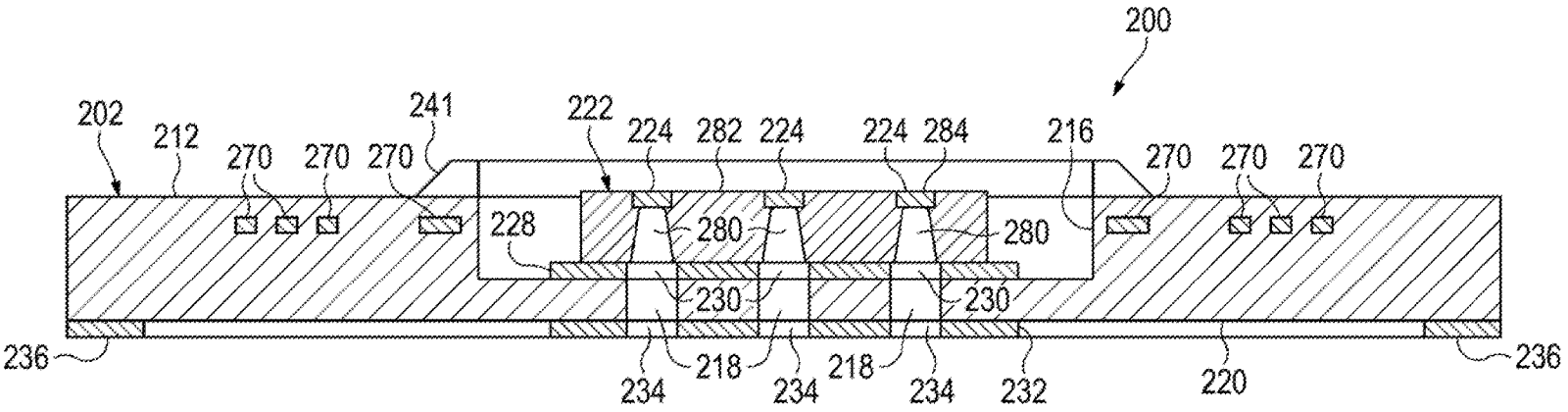
FIG. 9A is a cross-sectional view along view line 9-9 of FIG. 7 that illustrates some components of an example fluid ejection device.
Figure 9B:
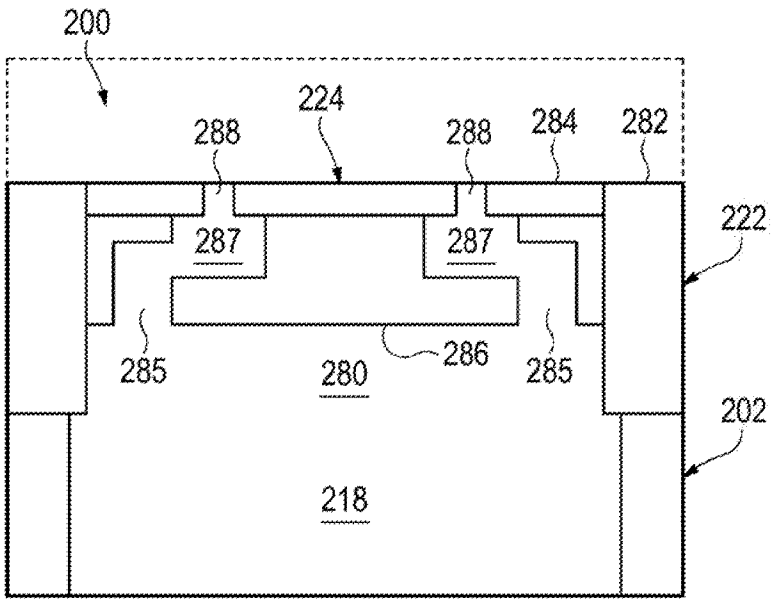
FIG. 9B is a block diagram illustrating some components of an example fluid ejection device similar to FIG. 9A.
Figure 10A:
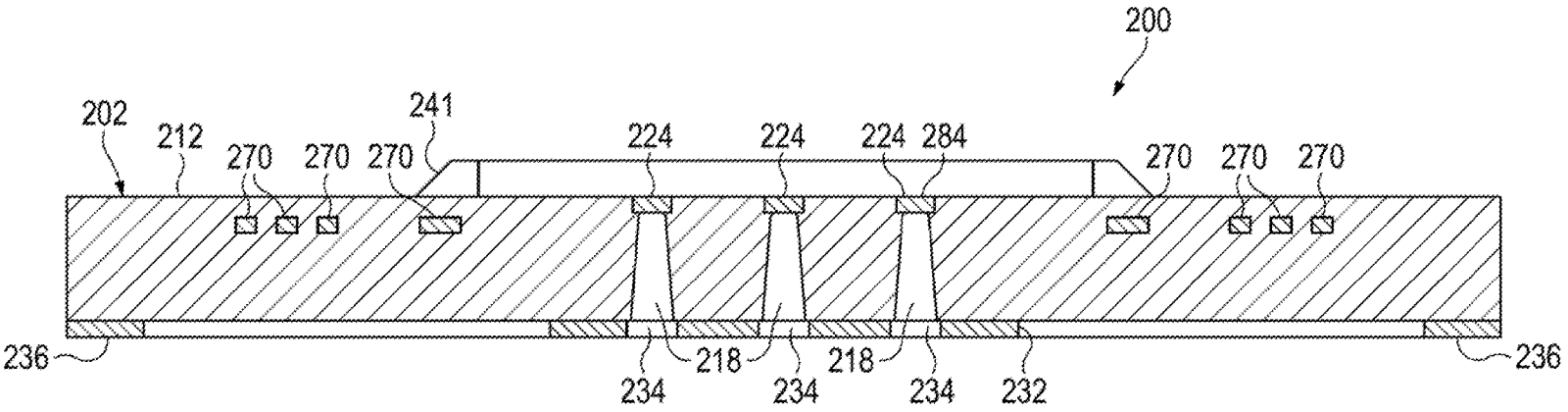
FIG. 10A is a cross-sectional view along view line 9-9 of FIG. 7 that illustrates some components of another example fluid ejection device.
Figure 10B:
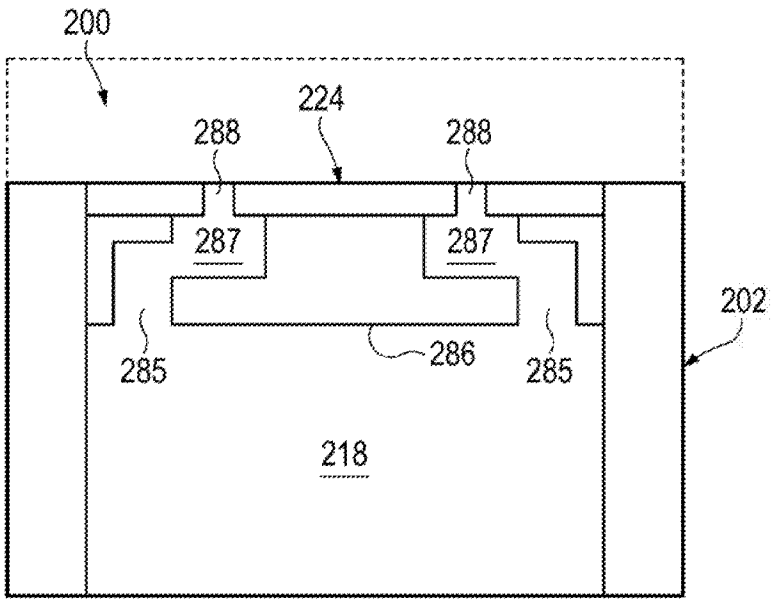
FIG. 10B is a block diagram illustrating some components of an example fluid ejection device similar to FIG. 10A.
Figure 11:
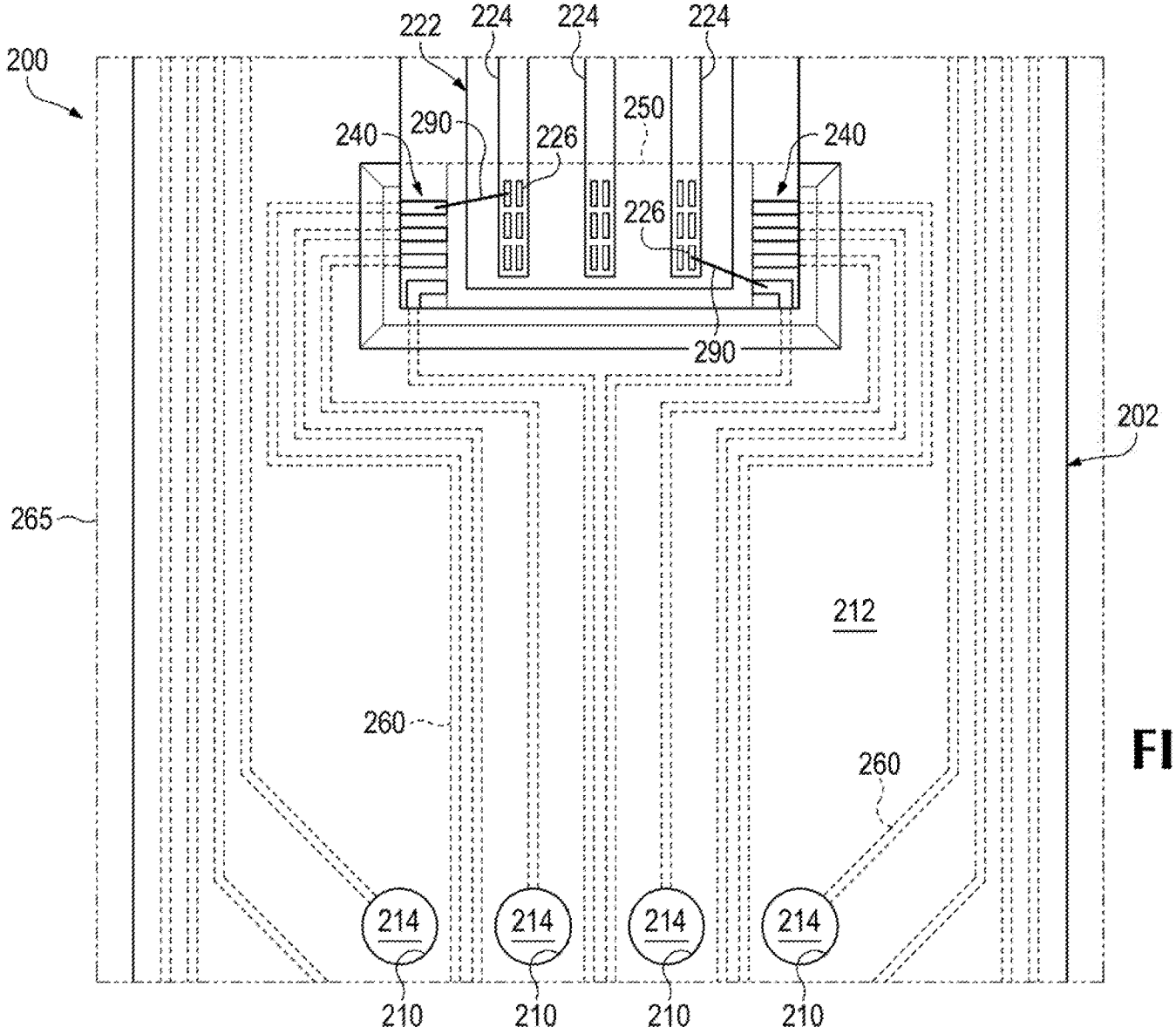
FIG. 11 is a detail view of the example fluid ejection device of FIG. 7.

In FIG. 5, an exploded isometric view from a top perspective of some components of an example fluid ejection device 200 is provided. FIG. 6 provides an exploded isometric view from a bottom perspective of some components of the example fluid ejection device 200. FIG. 7 provides a top view of some components of an example fluid ejection device 200. FIG. 8 provides a bottom view of some components of an example fluid ejection device 200. FIG. 9A provides a cross-sectional view along view line 9-9 of FIG. 7 according to some example fluid ejection devices 200. FIG. 9B provides a block diagram illustrating some components of example fluid ejection devices 200 similar to the example of FIG. 9A. FIG. 10A provides a cross-sectional view along view line 9-9 of FIG. 7 according to other example fluid ejection devices 200. FIG. 10 provides a block diagram illustrating some components of example fluid ejection devices 200 similar to the example of FIG. 9B. FIG. 11 provides a detail view of FIG. 7 illustrating some components of an example fluid ejection device 200.

Referring to FIGS. 5-11, the fluid ejection device 200 includes a carrier 202. The carrier 202 includes a first portion 204 and a second portion 206. The first portion 204 and the second portion 206 of the carrier 202 have an angle of orientation 208 therebetween that is nonparallel. In this particular example, the angle of orientation 208 is approximately 90°. While the angle of orientation 208 is illustrated in the isometric views of FIGS. 5 and 6, the top and bottom views of FIGS. 7 and 8 illustrate the portions as planar for illustrative purposes. It should be noted that the angle of orientation 208 in examples may be nonparallel—i.e., the first portion 204 and second portion 206 may be nonplanar. In some examples, the angle of orientation between the first portion and the second portion may be within a range of approximately 75° to approximately 105°.

The first portion of the carrier 202 includes an array of openings 210 formed through a top surface 212 of the carrier 202. Positioned in the array of openings 210 are an array of contact points 214. As with previous examples, the fluid ejection device 200 comprises a plurality of conductive traces at least partially embedded in the molded material of the carrier 202. At a first end, the conductive traces form the array of contact points 214. Furthermore, the first portion 204 of the carrier 202 may have alignment openings 215 formed through the carrier 202.

In this example, the second portion 206 of the carrier 202 includes a recess 216. As may be seen in the exploded view, die openings, in the form of fluid channels 218, are formed through a bottom surface 220 of the second portion 206 of the carrier 202 such that the fluid channels 218 are aligned in the recess 216. In this example, a chiclet 222 includes fluid ejection dies 224 at least partially embedded in the chiclet 222. At ends of each fluid ejection die 224, the fluid ejection device 200 includes sets of die connection points 226 that are electrically connected to the fluid ejection dies 224, the die connection points 226 may be formed on the ends of the fluid ejection dies 224, or the die connect pads may be formed on separate support elements, such as a silicon chip, PCB board, or other such substrate and electrically connected to the fluid ejection dies 224.

As shown, in some examples, the fluid ejection device 200 may include a first sealing member 228. The chiclet 222 may be disposed in the recess 216, and the first sealing member 228 may be positioned between the chiclet 222 and a bottom surface of the recess 216. As shown, the fluid channels 218 of the carrier 202 may align with openings 230 of the first sealing member 228. While not shown in FIGS. 5-6, the chiclet 222 may have fluid connection channels formed therethrough, and the fluid ejection dies 224 may include fluid passages formed through back surfaces thereof. The fluid channels 218 of the carrier 202 may be fluidically coupled to the fluid passages of the fluid ejection dies 224 through the openings 230 of the first sealing member 228 and the fluid connection channels of the chiclet 222.

In FIG. 6, the fluid ejection device 200 may further include additional sealing members 232-234, that may facilitate coupling of the carrier to additional components, such as a fluid cartridge housing. Similar to the first sealing member 228 shown in FIG. 5, a second sealing member 232 may include openings 236 may align with the fluid channels 218 of the carrier 202. As shown, a third sealing member 236 may approximately correspond to a perimeter of the second portion 206. Examples of sealing members 228, 232, 236 may be formed of various materials such as insulating and/or adhesive materials, including for example, dispensed epoxy adhesive, patterned die attach film, die attach adhesives (e.g., Henkel DP1005 and E3200), and/or other similar materials.

Returning to FIG. 5, in the recess 216, second ends of the conductive traces may form carrier connection points 240. Furthermore, proximate the recess 216 and/or fluid ejection dies 224, some examples may include beveled structures 241, which may at least partially surround a perimeter of the recess 216. In some examples, the beveled structures 241 may provide protection to surfaces of the fluid ejection dies 224. The fluid ejection device 200 may include sealing cap members 250. When the chiclet 222 is disposed in the recess 216, the carrier connection points 240 may be positioned proximate the sets of die connection points 226. To electrically connect the conductive traces of the fluid ejection device between the contact points 215 and the fluid ejection dies 224, the sealing cap members 250 may include interconnect traces that electrically connect the carrier connection points 240 and the die connection points 226. Moreover, the sealing cap members 250 may include insulating material and/or adhesive material that may insulate and/or seal the electrical connections and elements as well as secure the chiclet 222 and the carrier 202.

Referring to FIG. 7, as shown, conductive traces 260 are illustrated in phantom. As discussed previously, the conductive traces 260 of the fluid ejection die 200 may form, at first ends, the array of contact points 214 positioned in the first portion 204 of the carrier 202. As shown, the conductive traces 260 may extend from the array of contact points to the second portion 206 of the carrier 202. In examples in which a chiclet 222 is coupled to the carrier 202, second ends of the conductive traces 260 may form the carrier connecting points 240 (e.g., shown in FIG. 5). Furthermore, with regard to FIG. 7, a detail view 265 is denoted, which is further shown in FIG. 11.

In FIG. 8, as discussed previously, the second sealing member 232 may be disposed on the back surface 220 of the carrier 202, and the openings 234 of the second sealing member 232 may align with the fluid channels 218 formed through the back surface 220 of the carrier 202. The third sealing member 236 is illustrated as approximately corresponding to the perimeter of the second portion 206 of the carrier 202. In addition, as shown in FIG. 8, the fluid ejection device 200 may include a support frame 270 embedded in the carrier 202. As shown, the support frame 270 may comprise a plurality of support members that may be connected, and the support frame 270 may generally extend along a length of the carrier 202.

Referring to FIG. 9A, which is a cross-sectional view along view line 9-9 of FIG. 7, in this example, the fluid ejection device 200 includes the fluid ejection dies 224 molded into the chiclet 222, and the chiclet 222 is coupled to the carrier 202. In particular, the chiclet 222 is positioned in the recess 216 of the carrier 202. The cross-sectional view of FIG. 9A further illustrates fluid connection channels 280 of the chiclet 222 that were described previously. As shown, the fluid channels 218 of the carrier 202 are aligned with the openings 234 of the second sealing member 232. Furthermore, the fluid channels 218 are aligned with and fluidically coupled to the fluid connection channels 280 of the chiclet 222 (and the openings 230 of the first sealing member 228). As shown, the fluid connection channels 280 of the chiclet 222 facilitate conveyance of fluid to the back surfaces of the fluid ejection dies 224.

As described previously, the fluid ejection dies 224 include fluid passages formed through the back surfaces thereof. Accordingly, fluid may flow through the fluid channels 218 of the carrier 202 to the fluid passages of the fluid ejection dies 224 through the fluid connection channels 280 of the chiclet 222. In addition, as shown in FIG. 9A, in examples in which the fluid ejection device 200 includes a chiclet 222, a top surface 282 of the chiclet 222 may be approximately coplanar with a top surface 284 of the fluid ejection dies 224 and the top surface 212 of the carrier 202. Moreover, as shown in FIG. 9A, this example fluid ejection device 200 comprises three fluid ejection dies 224, and the fluid ejection dies are arranged in a parallel manner such that a first fluid ejection die is parallel with a second fluid ejection die and a third fluid ejection die.

FIG. 9B provides a block diagram of a fluid ejection device 200 having a chiclet 222 in which a fluid ejection die 224 may be at least partially embedded. As discussed previously, the fluid channel 218 of the carrier 218 may be fluidically coupled to the fluid connection channel 280 of the chiclet 222. In turn, the fluid connection channel 280 of the chiclet 222 may be fluidically coupled to fluid passages 285 formed through the back surface 286 of the fluid ejection die 224, and the fluid passages 285 may be fluidically coupled to fluid chambers 287. Finally, the fluid chambers 287 may be fluidically coupled to nozzles 288.

FIG. 10A illustrates a cross-sectional view along view line 9-9 of FIG. 7, in which the fluid ejection device 200 does not include a chiclet. As shown in this example, the fluid ejection dies 224 are molded into the carrier 202. Accordingly, the fluid channels 218 of the carrier may directly supply fluid to the back surface of the fluid ejection dies 224 (in which the fluid passages may be formed). In addition, in this example, it may be noted that the top surfaces 284 of the fluid ejection dies 224 are approximately coplanar with the top surface 212 of the carrier 202. FIG. 10 provides a block diagram of a fluid ejection device 200 in which the fluid ejection die 224 is at least partially embedded in the carrier 202. As shown, the fluid channel 218 is fluidically coupled to fluid passages 285 formed through the back surface 286 of the fluid ejection die 224. The fluid passages 285 are fluidically coupled to fluid chambers 287, which are fluidically coupled to nozzles 288.

FIG. 11 provides the detail view 265 noted in FIG. 7. As shown in FIG. 11, the array of contact points 214 aligned in the array of openings 210 of the carrier 202 may be connected to the sets of die connection points 226 of the fluid ejection dies 224. The sealing cap member 250 is illustrated in phantom such that the interconnect traces 290 that may connect the carrier connection points 240 of the conductive traces 260 to the sets of die connection points 226. Accordingly, external connectors may electrically connect with the array of contact points 214, and electrical signals may be transmitted between the fluid ejection dies 224 and the external connectors via the array of contact points 214, the conductive traces 260, the carrier connection points 240, the sets of die connection points 226 and the interconnect traces 290. While the example provided in FIG. 11 illustrates such electrical routing components, other examples may include different arrangements.

Figure 12:
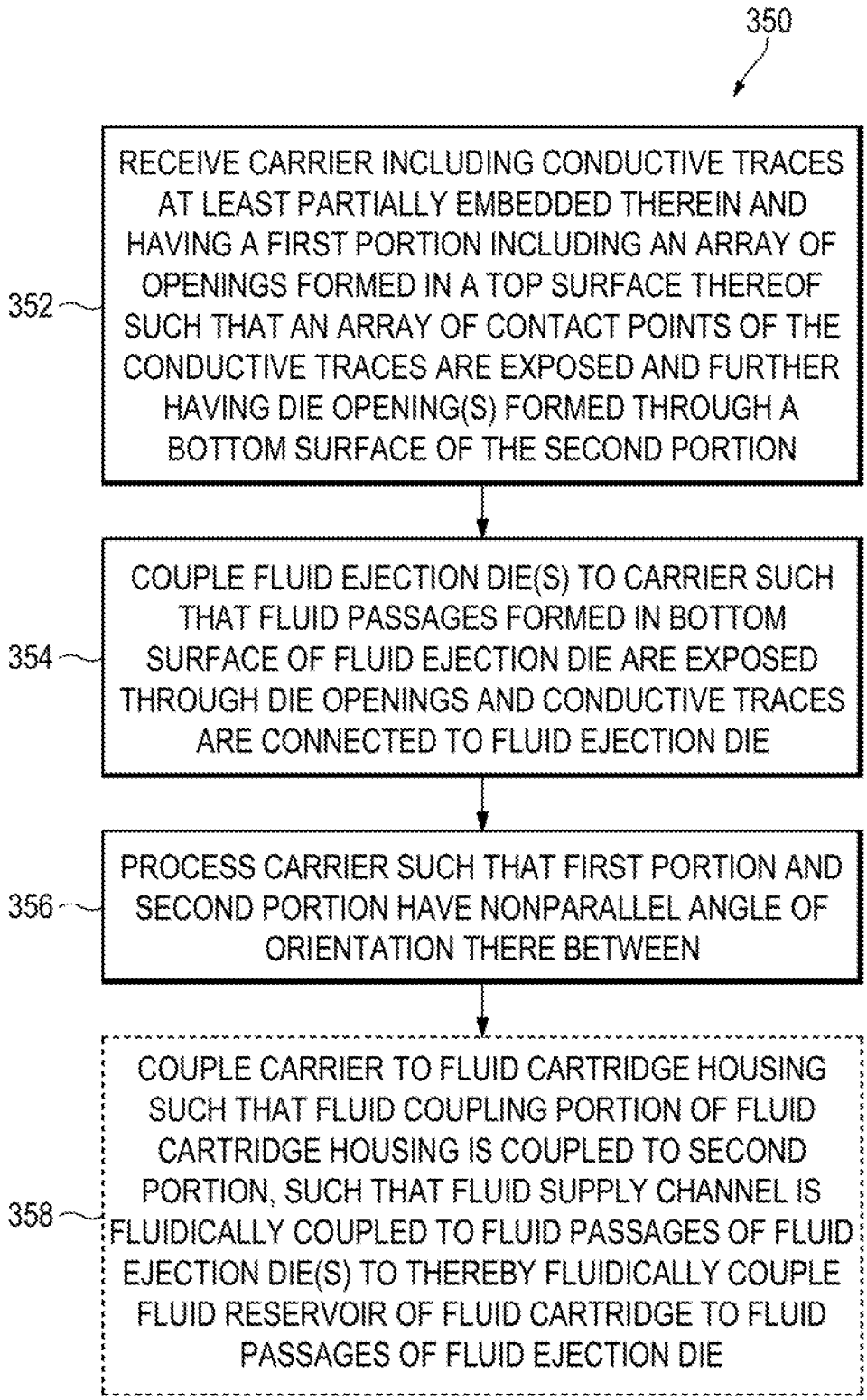
FIG. 12 is a flowchart that illustrates an example process.

FIG. 12 provides a flowchart of an example sequence of operations that may be performed by a process 350 for a fluid ejection device. As shown in the flowchart 350 of FIG. 12, a carrier having a first portion and a second portion may be received (block 352). The carrier may have a plurality of conductive traces at least partially embedded therein, and the carrier may have at least one die opening formed through a bottom surface thereof at the second portion. Furthermore, the first portion of the carrier may have an array of openings formed through a top surface thereof such that an array of contact points of the conductive traces are exposed through the array of openings.

At least one fluid ejection die may be coupled to the second portion of the carrier (block 354). By coupling the at least one fluid ejection die to the carrier, fluid passages formed in a bottom surface of the die are exposed through the die opening. In examples in which the die opening corresponds to a fluid channel, the fluid passages of the fluid ejection die may be fluidically coupled to the at least one fluid channel of the carrier. In addition, by coupling the fluid ejection die to the carrier, the conductive traces may be connected to the fluid ejection die. In some examples, coupling the fluid ejection die to the carrier may be performed by coupling a chiclet that includes the at least one fluid ejection die to the carrier with an adhesive. In other examples, receiving the carrier and coupling the fluid ejection die thereto may be performed concurrently. In other words, in such examples, the fluid ejection dies may be embedded into the carrier during formation of the carrier. For example, the carrier may be formed with an epoxy mold material in a molding process, and the fluid ejection dies may be coupled to the formed molded carrier during the molding process.

The carrier may be processed such that the first portion of the carrier and the second portion of the carrier have a nonparallel angle of orientation therebetween (block 356). In some examples, processing the carrier may comprise heating the carrier at a location between the first portion and the second portion to thereby facilitate movement between the first portion and the second portion. Concurrent with or after such heating, force may be applied to cause bending of the carrier between the first portion and the second portion. In some examples, an angle of orientation between the first portion and the second portion may be in a range of approximately 75° to approximately 105°. In some examples, an angle of orientation between the first portion and the second portion may be approximately 90°.

In some examples, a fluid ejection device may comprise a fluid cartridge housing coupled to a carrier as described herein. Accordingly, to form such examples, the process may further couple the carrier to a fluid cartridge housing (block 358). A fluid coupling portion of the of the fluid cartridge housing may be coupled with the second portion of the carrier such that the fluid supply channel of the housing is fluidically coupled to the fluid passages of the fluid ejection die. By coupling the fluid supply channel of the housing to the fluid passages of the fluid ejection die, the example may fluidically couple a reservoir of the fluid cartridge housing to fluid passages of the fluid ejection die. In examples in which the die opening may correspond to a fluid channel, the fluid passages of the fluid ejection die may be fluidically coupled to the fluid reservoir via the fluid channels of the carrier and the fluid supply channels of the fluid cartridge housing.

Figure 13:
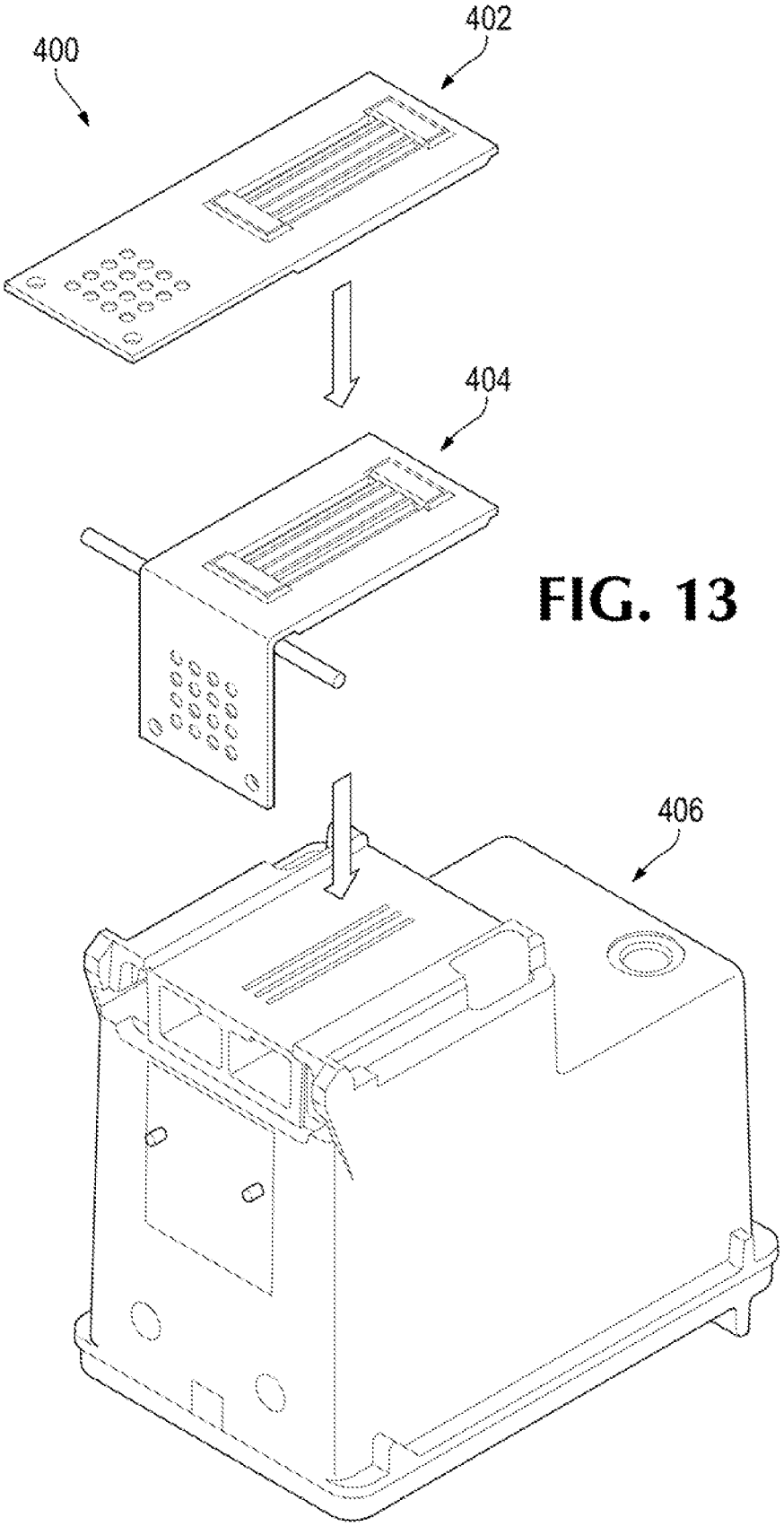
FIG. 13 is a flow diagram that illustrates an example process.

FIG. 13 provides a flow diagram that illustrates some operations of an example process for an example fluid ejection device. As shown, a carrier including an array of openings formed in a top surface of a first portion of the carrier and having fluid ejection dies coupled to a second portion of the carrier may be received (block 402). A bending process may be performed on the carrier such that the first portion and second portion are nonplanar, i.e., an angle of orientation between the first portion and the second portion is nonparallel (block 404). In this example, the angle of orientation between the first portion and the second portion is approximately 90°. The carrier may be coupled to a fluid cartridge housing (block 406). In particular, in this example, a fluid coupling portion of the fluid cartridge housing may be coupled to the second portion of the carrier. In some examples, such coupling may be performed with adhesive material, such as sealing members described above with respect to FIG. 6. By coupling the second portion of the carrier to the fluid coupling portion, fluid supply channels formed through the fluid coupling portion of the fluid cartridge housing may be aligned with and fluidically coupled to fluid channels of the carrier. Furthermore, the first portion of the carrier is coupled to an electrical coupling portion of the fluid cartridge housing such that alignment members of the fluid cartridge housing interface with alignment openings that pass through the first portion of the carrier.

Figure 14:
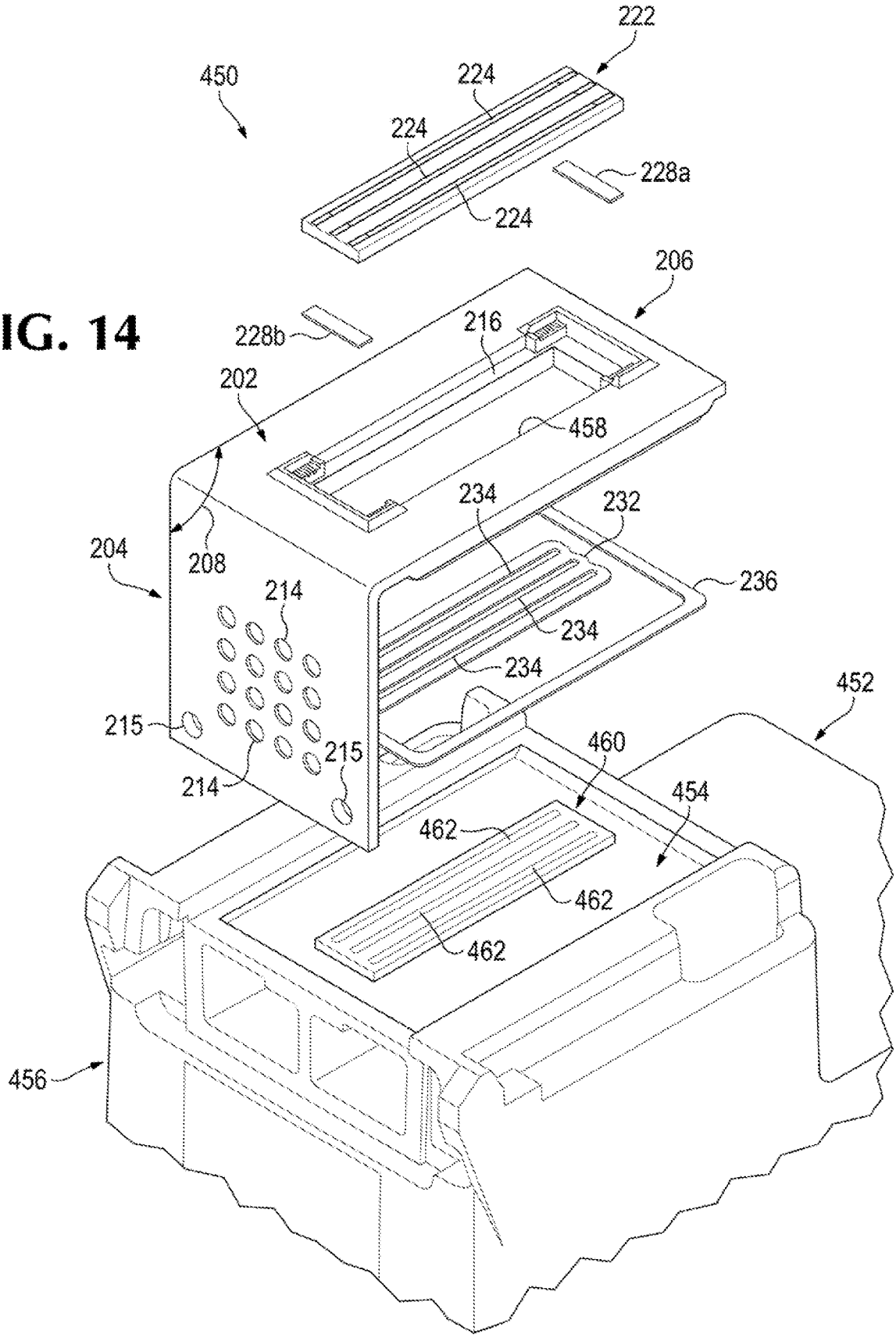
FIG. 14 is an exploded isometric view of some example components of an example fluid ejection device.

FIG. 14 provides an exploded isometric view of some components of an example fluid ejection device 450. Similar to the examples described in FIGS. 5-11, the example fluid ejection device includes a carrier 202 and fluid ejection dies 224 coupled to the carrier 202. As described previously, the carrier 202 may have a first portion 204 and a second portion 206 that have a nonparallel angle of orientation 208 therebetween. The carrier 202 may couple with a fluid cartridge housing 452. The fluid cartridge housing 452 may include a fluid coupling portion 454 with which the second portion 206 of the carrier 202 may couple. The fluid cartridge housing 452 may include an electrical coupling portion 456 with which the first portion 204 may couple. As mentioned previously, the carrier 202 may be a rigid carrier. Accordingly, an angle of orientation 208 between the first portion 204 and second portion 206 of the carrier 202 may be approximately equal to an angle of orientation between the electrical coupling portion 456 and the fluid coupling portion 454.

In the example of FIG. 14, the carrier includes a die opening 458 which is aligned with the recess 216. Accordingly, the chiclet 222 including the fluid ejection dies 224 may be positioned in the recess 216 such that the fluid connection channels of the chiclet 222 and the fluid passages of the fluid ejection dies 224 may be aligned in the die opening 458. As shown, the fluid coupling portion 454 of the fluid cartridge housing may include a fluid coupling structure 460 that protrudes from a surface of the fluid coupling portion 454. Fluid supply channels 462 of the fluid cartridge housing 452 may extend through the fluid coupling structure 460. As shown, the fluid supply structure 460 may correspond to the die opening 458 of the carrier 202 such that, when coupled together, the fluid connection channels of the chiclet 222 and the fluid passages of the fluid ejection dies 224 may be fluidically coupled to the fluid supply channels 462 of the fluid cartridge housing 452. As may be appreciated, in this example, the second sealing member 232 may engage the fluid supply structure 460 and a back surface of chiclet 222 and/or the fluid ejection dies 224. Moreover, in this example, the first sealing member may include two portions 228*a-b* that may facilitate coupling the chiclet 222 and the carrier 202.

Accordingly, examples provided herein may provide fluid ejection devices including a carrier having at least one fluid ejection die coupled thereto. Moreover, the fluid ejection device may have contact points through which external electrically connectors may be connected to fluid ejection dies on a first portion of the carrier, and the fluid ejection dies may be on a second portion of the carrier. The first portion and the second portion of the carrier may be nonplanar, such that an angle of orientation between the first portion and the second portion may be nonparallel.

The preceding description has been presented to illustrate and describe examples of the principles described. This description is not intended to be exhaustive or to limit these principles to any precise form disclosed. As used herein, "approximate" with regard to numerical values may indicate a range of ±10%. Moreover, while various examples are described herein, elements and/or combinations of elements may be combined and/or removed for various examples contemplated hereby. For example, the operations provided herein in the flowchart of FIG. 12 may be performed sequentially, concurrently, or in a different order. In addition, the components illustrated in the examples of FIGS. 1-11 may be added and/or removed from any of the other figures in any quantities. Many modifications and variations are possible in light of the description. Therefore, the foregoing examples provided in the figures and described herein should not be construed as limiting of the scope of the disclosure, which is defined in the Claims.

The invention claimed is:

1. A fluid ejection device comprising:

a carrier having a first portion and a second portion having a nonparallel angle of orientation therebetween, the first portion having an array of openings formed in a top surface of the carrier, and the second portion having at least one die opening formed through a bottom surface thereof;

a fluid ejection die coupled to the second portion of the carrier, the fluid ejection die including a plurality of fluid passages formed in a bottom surface of the fluid ejection die, the fluid passages of the fluid ejection die exposed through die opening formed through the bottom surface of the carrier; and a plurality of conductive traces at least partially embedded in the carrier, the plurality of conductive traces having an array of contact points at a first end, the array of contact points exposed through the array of openings formed in top surface of the carrier, the plurality of conductive traces connecting the fluid ejection die and the array of contact points.

2. The fluid ejection device of claim 1, wherein the fluid ejection die is a first fluid ejection die, the at least one die opening corresponds to a first fluid channel fluidically coupled to the fluid passages of the first fluid ejection die, the at least one die opening includes a second fluid channel formed through the bottom surface of the second portion, and the fluid ejection device further comprises:

a second fluid ejection die coupled to the carrier at the second portion and arranged in a parallel manner with the first fluid ejection die, the second fluid ejection die including a plurality of fluid passages formed in a bottom surface of the second fluid ejection die fluidically coupled to the second fluid channel, wherein the plurality of conductive traces are connected to the second fluid ejection die at a second end.

3. The fluid ejection device of claim 1, wherein the carrier includes a recess formed in a top surface of the second portion, and the fluid ejection die is disposed in the recess, the fluid ejection device further comprising:

a chiclet in which the fluid ejection die is at least partially embedded, the chiclet having a bottom surface in which a fluid connection channel is formed, the fluid connection channel of the chiclet fluidically coupled to the fluid passages of the fluid ejection die.

4. The fluid ejection device of claim 1, further comprising:

a support frame embedded in the carrier.

5. The fluid ejection device of claim 1, wherein the carrier is a molded carrier, and the fluid ejection die is at least partially embedded in the molded carrier.

6. The fluid ejection device of claim 1, further comprising:

a fluid cartridge housing, the fluid cartridge housing including at least one fluid reservoir therein, the fluid cartridge housing having a fluid coupling portion, the fluid cartridge housing including at least one fluid supply channel formed through the fluid coupling portion of the housing and fluidically coupled to the at least one fluid reservoir, wherein the second portion of the carrier is coupled to the fluid coupling portion, and the at least one fluid supply channel is fluidically coupled to the plurality of fluid passages.

7. The fluid ejection device of claim 6, wherein the fluid cartridge housing further includes an electrical interface portion, the electrical interface portion and the fluid coupling portion having an angle of orientation therebetween of at least 75 degrees, wherein the first portion of the carrier is to couple to the electrical interface portion of the fluid cartridge housing.

8. The fluid ejection device of claim 7, wherein the fluid cartridge housing includes alignment members disposed on the electrical connection portion, and the carrier includes alignment openings formed through the first portion of the carrier with which the alignment members of the fluid cartridge housing interface.

9. The fluid ejection device of claim 1, wherein the angle of orientation between the first portion and the second portion of the molded carrier is within a range of 75 degrees to 105 degrees.

10. The fluid ejection device of claim 1, wherein the fluid ejection die is a first fluid ejection die, and the fluid ejection device further comprises:

a second fluid ejection die coupled to the second portion of the carrier and arranged in a parallel manner with the first fluid ejection die; and a third fluid ejection die coupled to the second portion of the carrier and arranged in a parallel manner with the second fluid ejection die and the first fluid ejection die.

11. A process for a fluid ejection device, the process comprising:

receive a carrier having a first portion and a second portion, the carrier having a plurality of conductive traces at least partially embedded therein, the carrier having at least one die opening formed through a bottom surface thereof at the second portion, and the carrier having an array of openings formed through a top surface thereof at the first portion such that an array of contact points of the conductive traces are exposed through the array of openings of the molded carrier;

coupling a fluid ejection die to the carrier at the second portion such that fluid passages formed in a bottom surface of the fluid ejection die are exposed through the at least one die opening formed through the bottom surface of the carrier, the coupling including connecting the fluid ejection die to the conductive traces; and processing the molded carrier such that the first portion and the second portion of the molded carrier have a nonparallel angle of orientation therebetween.

12. The process of claim 11, wherein processing the carrier such that the first portion and the second portion of the carrier have a nonparallel angle of orientation comprises:

heating the carrier at a position between the first portion and the second portion.

13. The process of claim 11, wherein the angle of orientation between the first portion and the second portion is within a range of 75 degrees to 105 degrees.

14. The process of claim 11, further comprising:

after processing the carrier such that the first portion and the second portion of the carrier have a nonparallel angle of orientation therebetween, coupling the carrier to a fluid cartridge housing such that a fluid coupling portion of the fluid cartridge housing is coupled to the second portion of the carrier, a fluid supply channel of the fluid cartridge is fluidically coupled to fluid passages of the fluid ejection die such that a fluid reservoir of the fluid cartridge housing is fluidically coupled to fluid passages of the fluid ejection die via the fluid supply channel of the fluid cartridge housing.

15. A fluid ejection device comprising:

a fluid cartridge housing including a fluid coupling portion and an electrical coupling portion, the fluid cartridge housing having at least one fluid reservoir therein, the fluid cartridge housing having at least one fluid supply channel formed through the fluid coupling portion of the fluid cartridge housing, the at least one fluid supply channel fluidically coupled to the at least one fluid reservoir;

a carrier coupled to the fluid cartridge housing, the carrier having a first portion and a second portion having a nonparallel angle of orientation therebetween, the first portion having an array of openings formed in a top surface of the carrier, and the second portion having at least one fluid channel formed through a bottom surface thereof, the at least one fluid channel of the second portion of the carrier fluidically coupled to the at least one fluid supply channel of the of the fluid cartridge;

a fluid ejection die coupled to the carrier at the second portion, the fluid ejection die including a plurality of fluid passages formed in a bottom surface of the fluid ejection die, the fluid passages of the fluid ejection die fluidically coupled to the at least one fluid channel formed through the bottom surface of the carrier; and a plurality of conductive traces at least partially embedded in the carrier, the plurality of conductive traces having an array of contact points at a first end, the array of contact points exposed through the array of openings formed in top surface of the carrier, the plurality of conductive traces connecting the fluid ejection die and the array of contact points.

* * * * *